US007992506B1

(12) United States Patent
Patton et al.

(10) Patent No.: US 7,992,506 B1
(45) Date of Patent: Aug. 9, 2011

(54) HARNESS FOR KITEBOARDING

(76) Inventors: Jerome R. Patton, Bozeman, MT (US); John K. Lampe, Saint Paul, MN (US)

( * ) Notice: Subject to any disclaimer, the term of this patent is extended or adjusted under 35 U.S.C. 154(b) by 556 days.

(21) Appl. No.: 11/744,311

(22) Filed: May 4, 2007

Related U.S. Application Data

(60) Provisional application No. 60/797,544, filed on May 4, 2006.

(51) Int. Cl.
*B63H 9/04* (2006.01)
*B64G 31/06* (2006.01)

(52) U.S. Cl. ..... 114/39.18; 244/155 R

(58) Field of Classification Search ..... 244/155 R, 244/155 A, 151 R; 114/39.16, 98–99, 39.18; 182/3, 4, 231
See application file for complete search history.

(56) References Cited

U.S. PATENT DOCUMENTS 3,004,519 A * 10/1961 Weissman ..... 119/857
4,112,865 A 9/1978 Carn
4,452,161 A * 6/1984 McCoy ..... 114/39.18
4,508,045 A 4/1985 Spanier
4,588,044 A 5/1986 Mader
4,630,563 A * 12/1986 Pertramer ..... 114/39.16
4,745,870 A 5/1988 Roth
4,759,306 A 7/1988 McKenzie
4,763,591 A * 8/1988 Taylor ..... 114/39.18
5,050,516 A 9/1991 Soudan, Jr.
5,069,153 A 12/1991 Pascher
5,134,951 A 8/1992 Nishimura
5,402,742 A 4/1995 Kiaulehn
5,449,309 A * 9/1995 McCarty ..... 441/69
5,505,152 A 4/1996 Huber
6,293,215 B1 * 9/2001 Moorrees ..... 114/39.18
6,513,759 B2 2/2003 Starbuck
6,514,115 B2 2/2003 Harich
6,745,713 B2 6/2004 Starbuck
7,445,085 B2 * 11/2008 Petzl et al. ..... 182/6
2002/0088385 A1 * 7/2002 Thompson ..... 114/39.16
2003/0116071 A1 6/2003 Starbuck
2004/0182968 A1 * 9/2004 Gentry ..... 244/155 A
2005/0011425 A1 1/2005 Suh
2005/0279797 A1 12/2005 Martin et al.

* cited by examiner

*Primary Examiner* — Tien Dinh
(74) *Attorney, Agent, or Firm* — Sherrill Law Offices, PLLC

(57) ABSTRACT

A kiteboarding harness and method of kiteboarding with the harness. The harness has a hook extending radially outward from the harness and slidably attached to the harness for lateral repositioning of the hook on the harness about the anteroposterior axis of a human wearing the harness.

9 Claims, 10 Drawing Sheets

HARNESS FOR KITEBOARDING

This application claims the benefit of U.S. Provisional Application No. 60/797,544, filed May 4, 2006.

BACKGROUND OF THE INVENTION

Kiteboarding (also known as kitesurfing) is the latest extreme sports craze. A kiteboarder (i.e., the human operator) is pulled on a board by a kite. The board can be specially designed for kiteboarding, or it can be another type of board or support, such as a snowboard, landboard, skates, iceboard, buggy, wake ski, etc. The kiteboarder usually wears a harness for transmitting the pull force of the kite to the body of the wearer. The harness is connected to the kite (also known as the sail) through appropriate rigging, such as a control bar. The kite can pull a kiteboarder over many different surfaces, including water, ice, snow and even terra firma, as well as into the air.

The harness usually includes a laterally elongated metal spreader bar attached at each end to a garment (i.e., a girdle or vest). A heavy-duty hook is rigidly attached to the spreader bar intermediate the ends of the bar. The hook extends outward from the harness near the pelvis for catching a "chicken loop" (also known as a "harness loop") on the control bar.

While generally effective for transmitting the pull force of the kite throughout the body of the wearer, the harness tends to exert a constant twisting or torsion force upon the body of the wearer whenever the kiteboarder desires to ride at an angle relative to the direction of the pull force of the kite, and also tends to exert a "jerking" torsion force upon the body of the wearer whenever the kite makes a significant lateral shift relative to the wearer. Such torsion forces tend to prematurely fatigue the kiteboarder and reduce the kiteboarders overall enjoyment of the sport.

Numerous variations exist in the hardware used to attach kiteboard rigging to a kiteboard harness. Unfortunately, all suffer from certain shortcomings or limitations which adversely impact the performance or comfort of the harness. The purpose of the present invention is to overcome these and other shortcomings or limitations in the prior art.

SUMMARY OF THE INVENTION

A first aspect of the invention is a kiteboarding harness with a hook extending radially outward from the harness and slidably attached to the harness for lateral repositioning of the hook on the harness about the anteroposterior axis of a human wearing the harness.

A second aspect of the invention is a method of kiteboarding. The method includes the steps of (i) donning a kiteboarding harness with a hook extending radially outward from the harness and slidably attached to the harness for lateral repositioning of the hook on the harness about the anteroposterior axis of the human wearing the harness, (ii) attaching a kiteboarding kite to the hook, (iii) flying the kite while standing upon a board whereby the human wearing the harness and the board are pulled by the flying kite atop a supporting surface, and (iv) allowing the hook to be freely repositioned on the harness about the anteroposterior axis of the wearer under influence from the pull of the kite.

DETAILED DESCRIPTION OF THE INVENTION

Nomenclature

Figure 1:
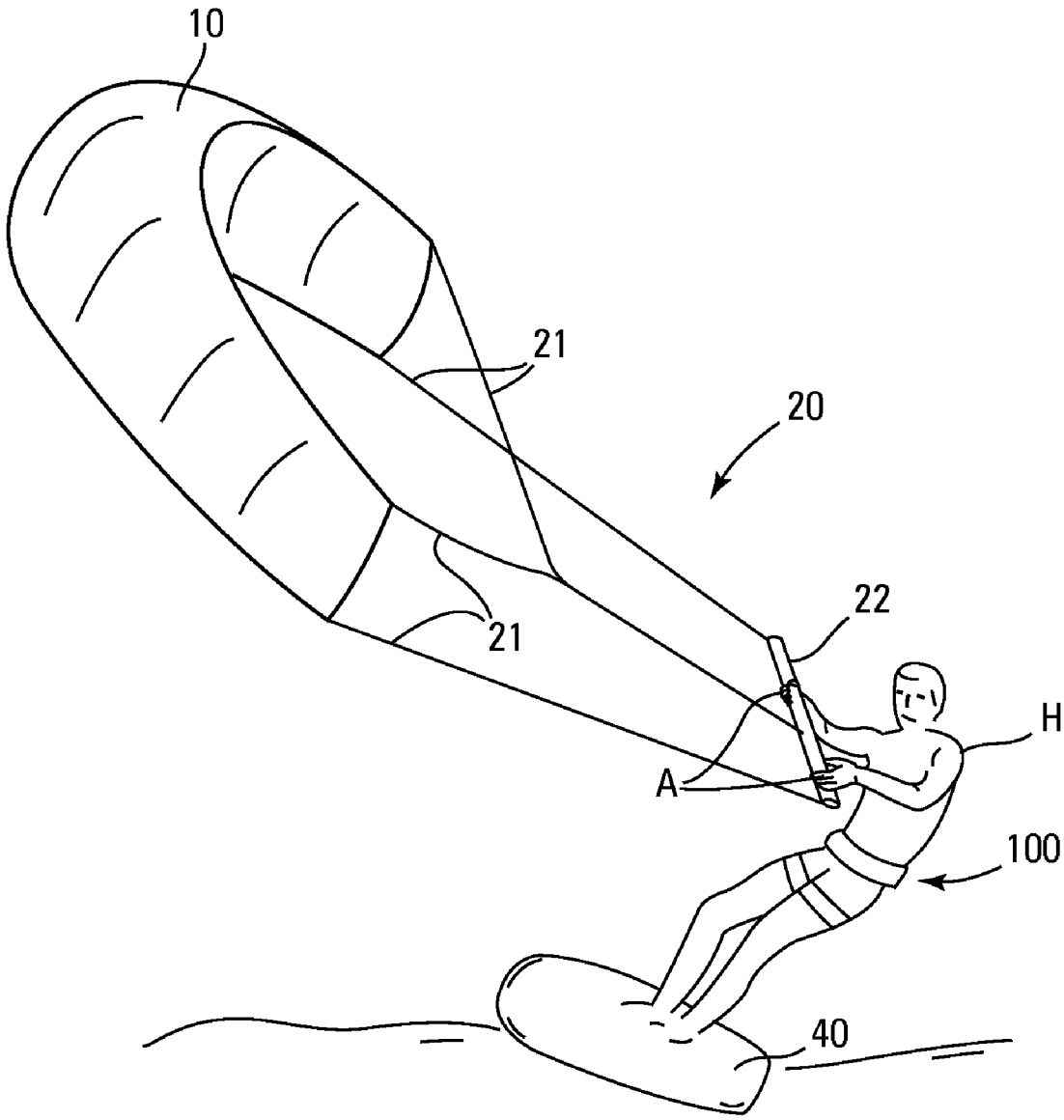
FIG. 1 is a perspective view of a kiteboarder kiteboarding with one embodiment of the invention.

| | |
|---|---|
| 10 | Kite |
| 20 | Rigging |
| 21 | Flight Lines |
| 22 | Control Bar |
| 23 | Chicken Loop |
| 40 | Board |
| 100 | Harness (First Embodiment) |
| $100_F$ | Front of Harness |
| $100_B$ | Back of Harness |
| 102 | Lateral Strap |
| 110 | Girdle |
| 120 | Guide Line |
| 120a | First Attachment Point |
| 120b | Second Attachment Point |
| 129 | Gap |
| 130 | Hook |
| 135 | Release Nut and Spring-Held Gate |
| 200 | Harness (Second Embodiment) |
| $200_F$ | Front of Harness |
| $200_B$ | Back of Harness |
| 300 | Harness (Third Embodiment) |
| $300_F$ | Front of Harness |
| $300_B$ | Back of Harness |
| 336 | Slide Head on Hook |
| 340 | Track |
| 349 | Lateral Channel in Track |
| 400 | Harness (Fourth Embodiment) |
| $400_F$ | Front of Harness |
| 421 | Superior Guide Line |
| 422 | Inferior Guide Line |
| 431 | Superior Eyelet in Hook |
| 432 | Inferior Eyelet in Hook |
| 433 | Universal Joint in Hook |
| 434 | Hooking Portion of Hook |
| 500 | Harness (Fifth Embodiment) |
| $500_F$ | Front of Harness |
| 536 | Slide Head on Hook |
| 540 | Track |
| 541 | Superior Rail |
| 542 | Inferior Rail |
| 549 | Lateral Slot in Track |
| LR | Left Right Axis |
| AP | Anteroposterior Axis |
| H | Human or Kiteboarder or Wearer |
| $H_A$ | Anterior of Human |
| $H_P$ | Posterior of Human |
| A | Hand |
| P | Pelvis |
| $P_R$ | Right Side of Pelvis |
| $P_S$ | Left Side of Pelvis |
| W | Waist |
| x | Coronal Plane |

-continued

| | |
|---|---|
| y | Median Plane |
| Lat | Lateral Direction |
| Q | Directional Pull Force of Kite |

DEFINITIONS

As utilized herein, including the claims, the term "rigging" refers to all components and elements connecting the harness 100 to the kite 10.

CONSTRUCTION AND USE OF SPECIFIC EMBODIMENTS

Kiteboarding requires a kite 10, rigging 20 and a harness 30 to controllably attach the kite 10 to the kiteboarder H, and a board 40 suitable for sliding, gliding or riding across a surface.

The invention is directed to a kiteboarding harness 100, 200, 300, 400, 500 (hereafter collectively referenced as 100) capable of significantly reducing or eliminating the exertion of twisting or torsion forces on the body of a wearer H about the anteroposterior axis AP.

While described in connection with kiteboarding, the invention is not limited to such use. The structure of the harness 100 may be useful for other purposes. Other uses might include, for example, as harnesses 100 in sail boarding, sailing, hang gliding and other activities where a harness 100 might be usable and beneficial. The invention should be understood to encompass these other uses, although not be discussed below.

First Embodiment

Figure 2:
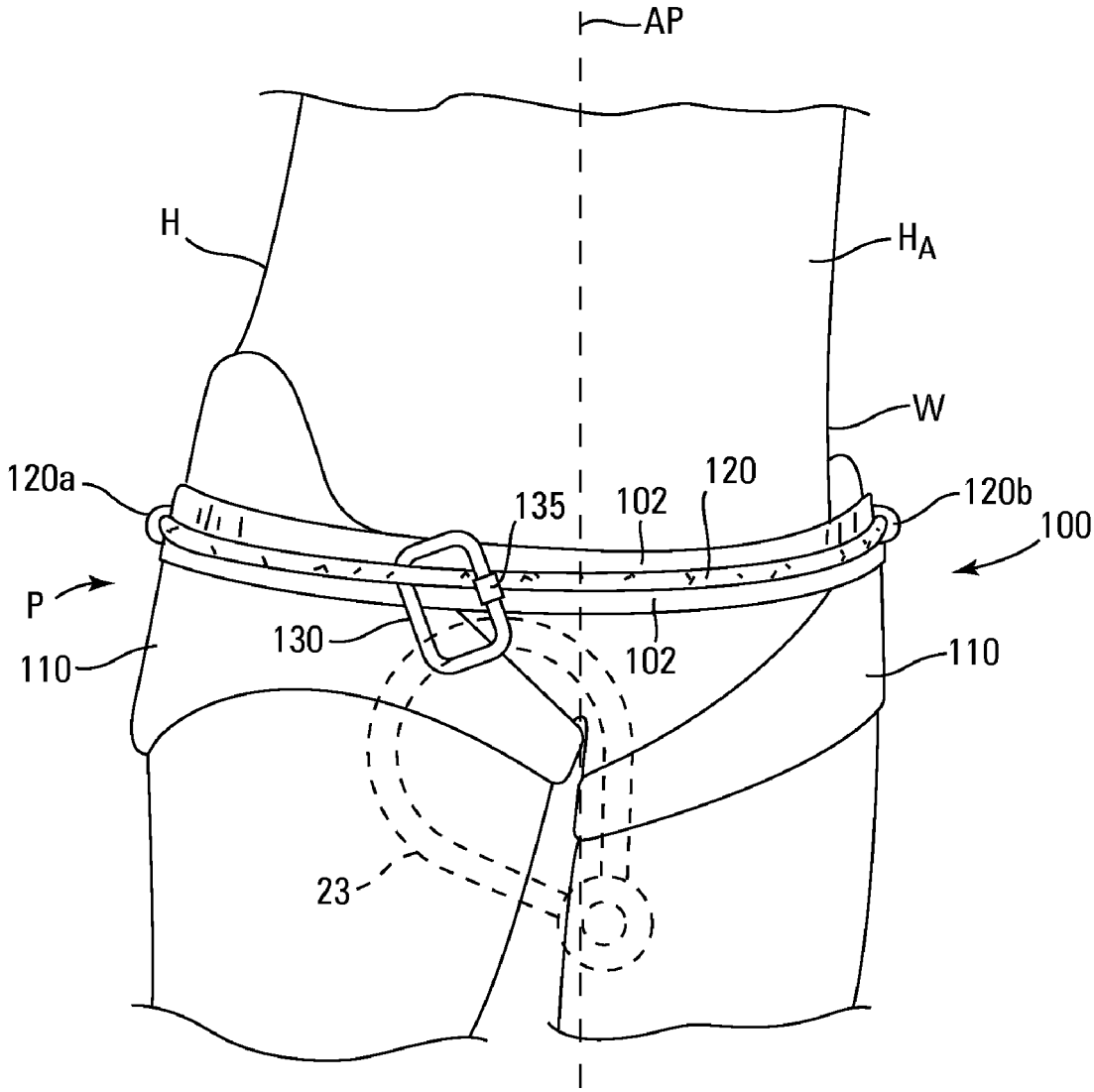
FIG. 2 is an enlarged front perspective view of the invention shown in FIG. 1 worn by a kiteboarder.
Figure 3:
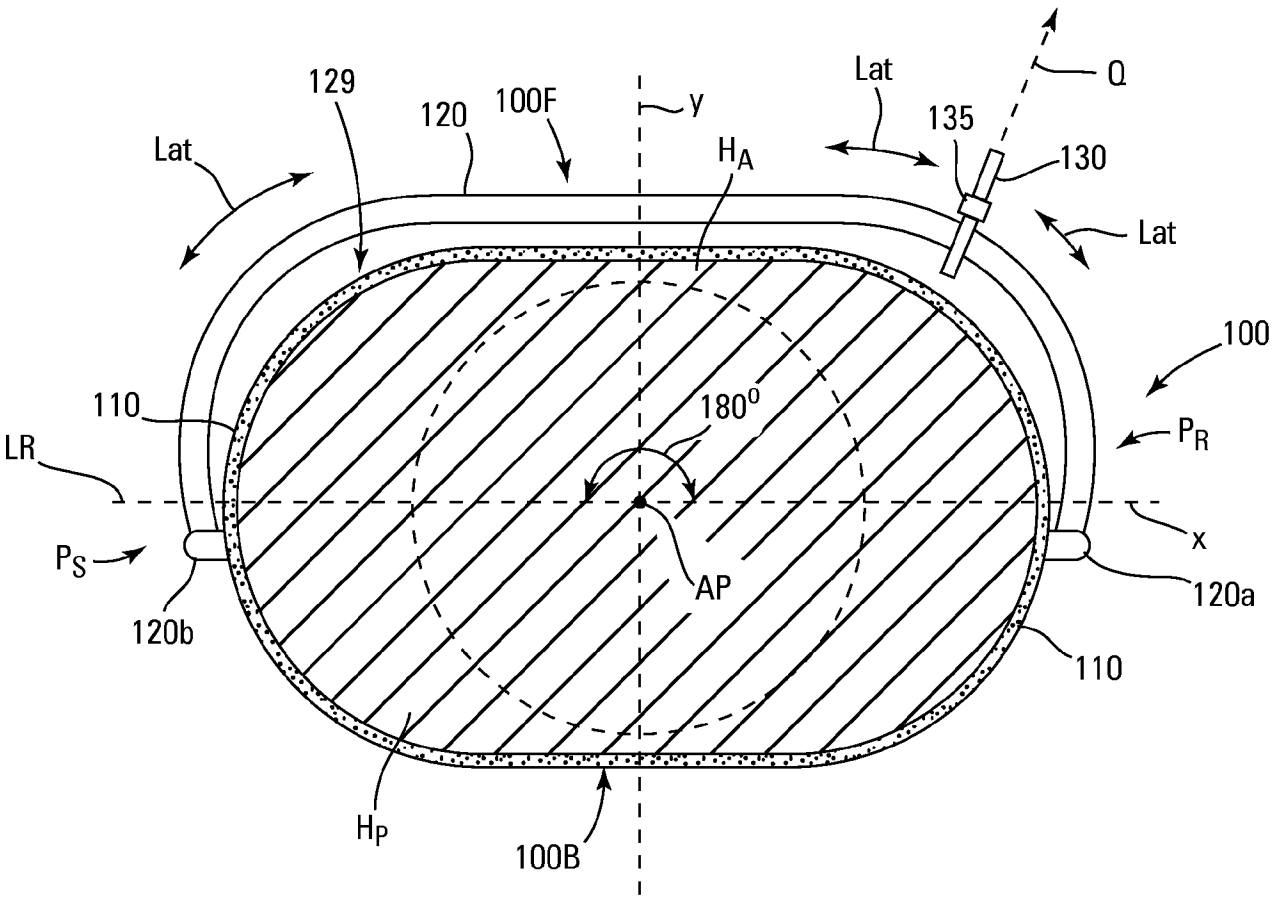
FIG. 3 is a top view of the invention shown in FIG. 2.

A first embodiment of the harness 100 is shown in FIGS. 1-3. The harness 100 has a front $\mathbf{100}_F$ and a back $\mathbf{100}_B$, and includes a girdle 110, a guide line 120, and a hook 130. A laterally Lat extending backing strap 102 may be provided underneath (i.e., medial) the guide line 120 for facilitating sliding of the hook 130 along the guide line 120 and/or preventing the hook 130 from rubbing against a wearer H as the hook 130 slides along the guide line 120. The hook 130 secures a kite 10 to the harness 100 via conventional rigging 20 such as flight lines 21, a control bar 22 and a chicken loop 23. The hook 130 is attached to the guide line 120 so that it can slide laterally Lat along the length of the guide line 120 about the anteroposterior axis AP of a wearer H. The guide line 120 on the first embodiment of the harness 100 is attached at each end 120*a* and 120*b* to the girdle 110 so as to permit the hook 130 to slide along the guide line 120 in excess of 180° about the anteroposterior axis AP of the wearer H. As shown in FIGS. 2 and 3, the hook 130 can slide across the front $\mathbf{100}_F$ of the harness 100 and the anterior $H_A$ of the wearer H from the right side of the wearer's pelvis $P_R$, just past the right side of the left right axis LR, to the left side of the wearer's pelvis $P_s$ just past the left side of the left right axis LR.

The girdle 110 securely and comfortably attaches the hook 130 in proper position to a kiteboarder H. Girdles 110 are a conventional piece of kiteboarding equipment. The present invention can be employed with substantially any girdle 110. The invention can also be used with a vest (not shown). The girdle 110 can be made of many different materials. For example, portions of it can be made of nylon webbing with various kinds of reinforcement and padding as are known in the art.

The guide line 120 can be attached to the girdle 110 at the attachment points 120*a* and 120*b* by any suitable type and means of attachment, ranging from stitching to rivets.

The guide line 120 can be rigid or flexible. The guide line 120 can be a flexible member, such as rope, aircraft cable, webbing, strap, or belt, or a rigid member such as a bar or beam. For many applications, a braided rope made of synthetic materials such as polypropylene or polyester is preferred. Such material should be lightweight, durable, wear resistant and capable of handling high pull forces. Ropes used for climbing are suitable for use as the guide line 120. Other types of rope can also be used such as coated ropes (also known as "dry ropes"), ropes encased in flexible tubing and ropes made of natural fibers such as cotton or hemp. Other types of materials may also be suitably used, such as plastics, fiberglass, graphite, aluminum, stainless steel, titanium, etc.

As shown in FIG. 3, the guide line 120 can be spaced from the girdle 110 to create a gap 129 between the wearer H and the guide line 120. This gap 129, up to two or three centimeters in depth, can allow the hook 130 to freely slide along the length of the guide line 120. In some circumstances it may be preferable, especially when the guide line 120 is a flexible member such as rope, for the guide line 120 to fit snugly against the girdle 110 and the body of the kiteboarder H. Other spatial relationships may be desired when other types of materials are used or for other applications, still other spatial relationships might be preferable.

The guide line 120 can be of various cross-sectional shapes, diameters or dimensions depending on various factors. For many applications, round rope with a diameter of approximately 3-30 millimeters is suitable. Other diameters or other dimensions are also suitable.

The hook 130 can be configured and arranged to slide smoothly along the length of the guide line 120. A suitable hook 130 is a carabiner, such as depicted in FIGS. 2 and 3. The carabiner is preferably a locking carabiner (i.e., equipped with a spring-held gate and release nut 135). The hook 130 must be capable of releasably engaging and holding the rigging 20, typically the chicken loop 23. The hook 130 can be made from many materials including metals, such as aluminum and steel, and plastics, such as polyurethane. The hook 130 may include a wheel, pulley, or other device (not shown) for facilitating movement of the hook 130 along the guide line 120.

The harness 100 has many uses and offers several advantages. A first advantage is that the harness 100 provides a kiteboarder H with greater freedom of movement relative to prior art harnesses. While kiteboarding, the pull-force Q provided by the kite 10 can come from virtually any point above the surface on which the kiteboarder H is boarding. While kiteboarding, the kite 10 tends to change position frequently, resulting in frequent changes in the direction of the pull-force Q. In order to maximize distribution of the pull-force Q throughout the body of the kiteboarder H, the line of the pull-force Q should extend through or at least proximate the anteroposterior axis AP of the kiteboarder's body H. By allowing the hook 130 to reposition itself along the guide line 120, the harness 100 is cable of quickly adjusting with changes in the position of the pull-force Q so as to keep the direction of the pull-force Q in line with or at least proximate the anteroposterior axis AP of the kiteboarder's body H.

This advantage is especially beneficial when the direction of the pull-force Q changes so as to pull from a direction posterior $H_P$ to the wearer H. When this happens to a harness with a hook fixedly attached to the front of the harness, the rigging 20 (i.e., the chicken loop 23 and control bar 22) will wrap across the body of the kiteboarder H, causing discomfort, chafing and/or brusing.

A second advantage of the harness 100 is that the hook 130 can be biased and locked into a closed position so as to prevent accidental and unintended release of the rigging 20 while still permitting a quick release of the of rigging 20 by the wearer H should circumstances dictate.

A third advantage of the harness 100 is enhanced comfort. Traditional kiteboarding harnesses have a metal spreader bar across the front of the harness. These metal spreader bars are uncomfortable and can cause injury to the wearer H, especially during a fall or crash. In contrast, the guide line 120 can be constructed from a relatively soft and pliable material.

The guide line 120 can be attached to the girdle 110 so as to permit lateral Lat travel of the hook 130 along the guide line 120 through at least a 30° angle, preferably at least a 90° angle and most preferably at least a 180° angle relative to the anteroposterior AP axis.

The guide line 120 can be positioned and attached to a kiteboarder H in a myriad of ways. For example, the guide line 120 could be integrated into a pair of shorts (not shown), a belt (not shown), a vest (not shown) a body suit (not shown), etc. The guide line 120 could also conceivable be attached directly to the body of a kiteboarder H with an adhesive (not shown).

The guide line 120 can be attached substantially anywhere on the torso (not numbered) of a kiteboarder H from the chest (not shown) to the waist W based upon the desires and preferences of the kiteboarder H.

The guide line 120 can be fixedly attached (i.e., directly attached by stitching and/or rivets) or releasably attached (i.e., via a buckle, clip or carabiner) to the girdle 110.

Separate components can be employed to provide the sliding and hooking functions of the hook 130. For example, a closed ring (not shown) can slidably encircle the guide line 120 while a carabiner 130, hooked onto the closed ring, provides the hooking function. The hook 130 can be permanently attached to the guide line 120 or releasably attached to the guide line 120 (i.e., a mechanism on the hook 130 permitting detachment of the hook 130 from the guide line 120 or a mechanism on the guide line 120 for permitting detachment of the guide line 120 from the girdle 110 and thereby allowing the hook 130 to be slid off the end of the detached guide line 120.

The guide line 120 and hook 130 could be configured so as to allow them to be retrofit onto an existing harnesses.

The hook 130 could be configured and arranged to permit direct attachment of the hook 130 to a control bar 22 (i.e., a "built-in" chicken loop) or even directly to the flight lines 21.

Second Embodiment

Figure 4:
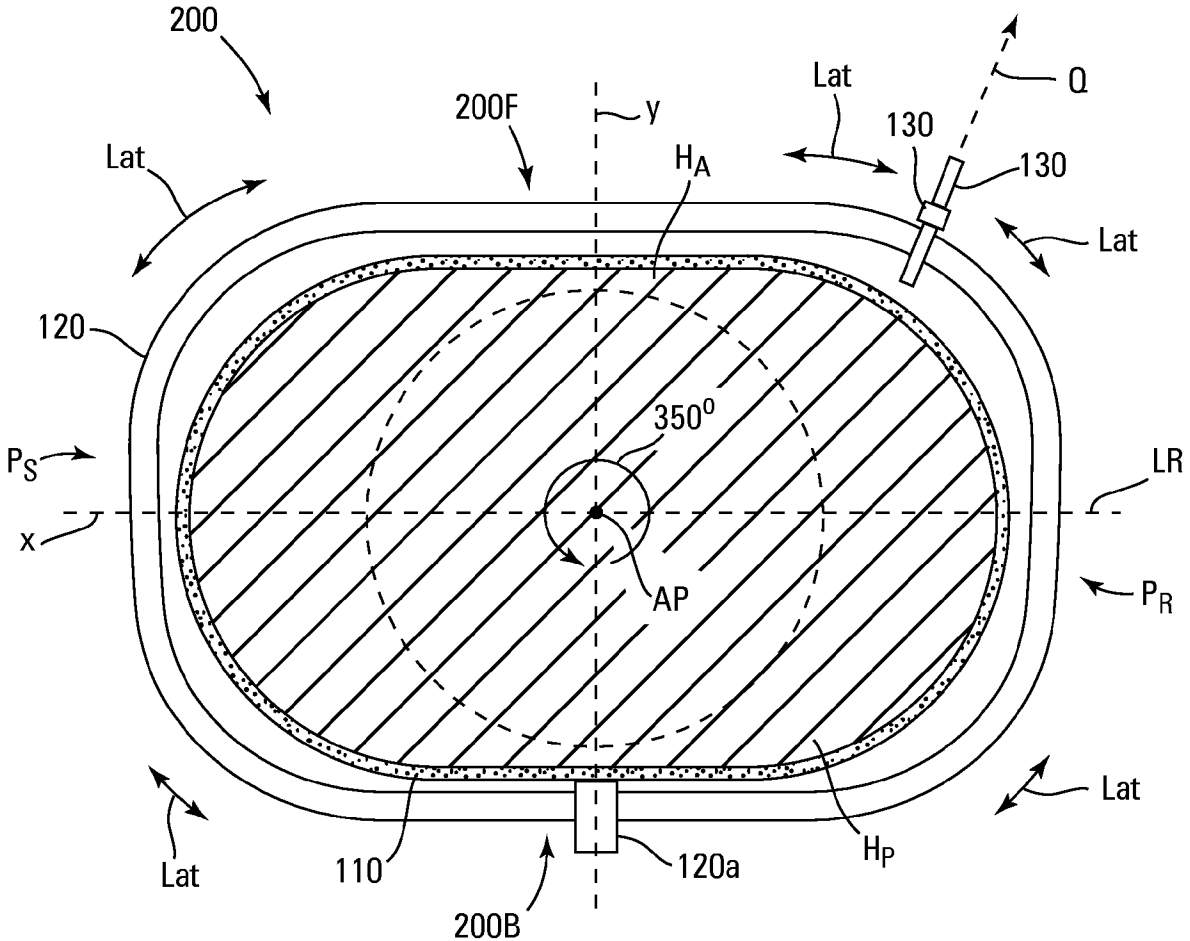
FIG. 4 is a top view of a second embodiment of the invention.

FIG. 4 shows a second embodiment of the harness 200 with a front portion $\mathbf{200}_F$ and a rear portion $\mathbf{200}_B$ separated by the coronal plane x. The second embodiment of the harness 200 substantially resembles the first embodiment of the harness 100, except that the guide line 120 encircles the pelvis P with a single point of attachment 120*a* in the median plane y. By providing a single point of attachment the hook 130 can slide nearly 360° along the guide line 120 around the pelvis P.

Third Embodiment

Figure 5:
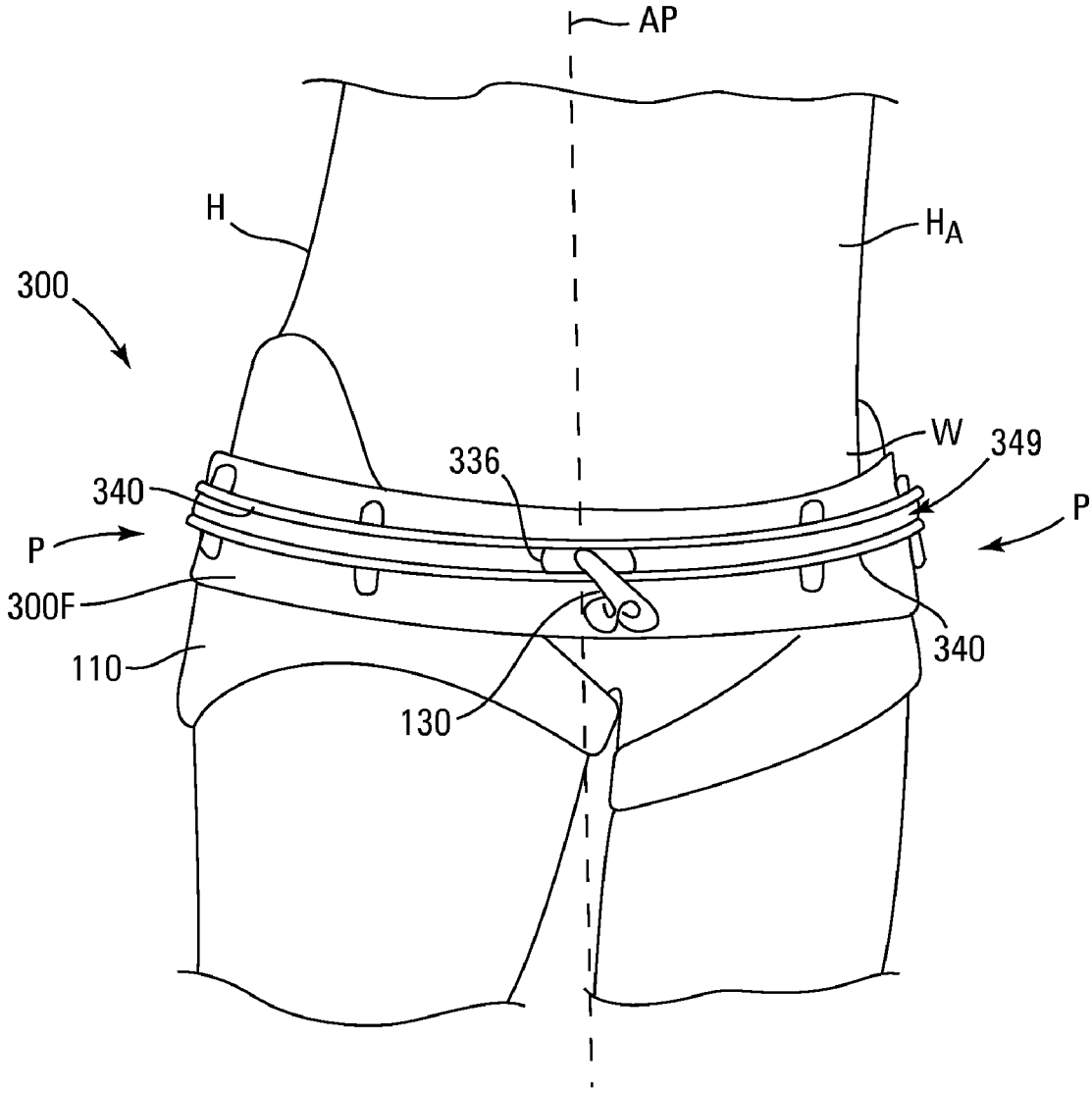
FIG. 5 is a front perspective view of a third embodiment of the invention worn by a kiteboarder.
Figure 6:
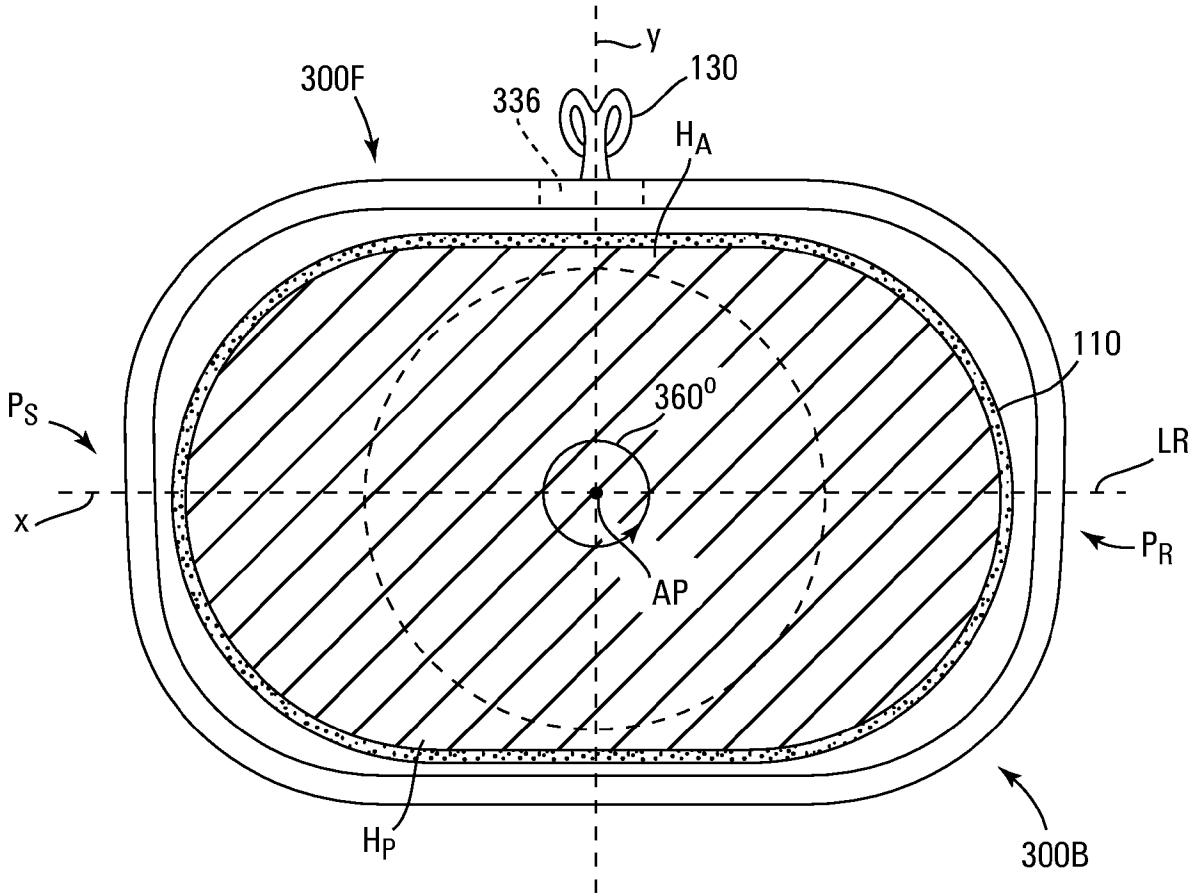
FIG. 6 is a top view of the invention shown in FIG. 5.

FIGS. 5 and 6 show a third embodiment of the harness 300 with a front portion $\mathbf{300}_F$ and a rear portion $\mathbf{300}_B$ separated by the coronal plane x. The third embodiment of the harness 300 substantially resembles the second embodiment of the harness 200, except that the guide line 120 is replaced with a track 340.

The track 340 encircles the pelvis P and includes a C-shaped lateral channel 349. A head 336 is provided on the proximal end of the hook 130 for sliding engagement within the channel 349 in the track 340.

The track 340 can be made from any material capable of bearing the pull forces Q exerted by the kite 10. Preferred materials include metals, such as aluminum and steel, and plastics, such as polyurethane.

The third embodiment of the harness 300 provides several significant advantages. First, the harness 300 permits the hook 130 to slide completely around the pelvis P, thereby permitting a kiteboarder H to rotate 360° or more relative to the kite 10 without wrapping the rigging 20 (e.g., typically the chicken loop 23) around the body. This provides a kiteboarder H with a tremendous amount of freedom to rotate and to perform tricks or stunts.

Second, the mechanism for slidably connecting the hook 130 to the harness 300 can be constructed to allow the hook 130 to travel laterally Lat around the wearer H with little or no friction, thereby virtually eliminating the creation of torsion forces (i.e., forces tending to twist the body of the wearer H about the anteroposterior axis AP).

Fourth Embodiment

Figure 7:
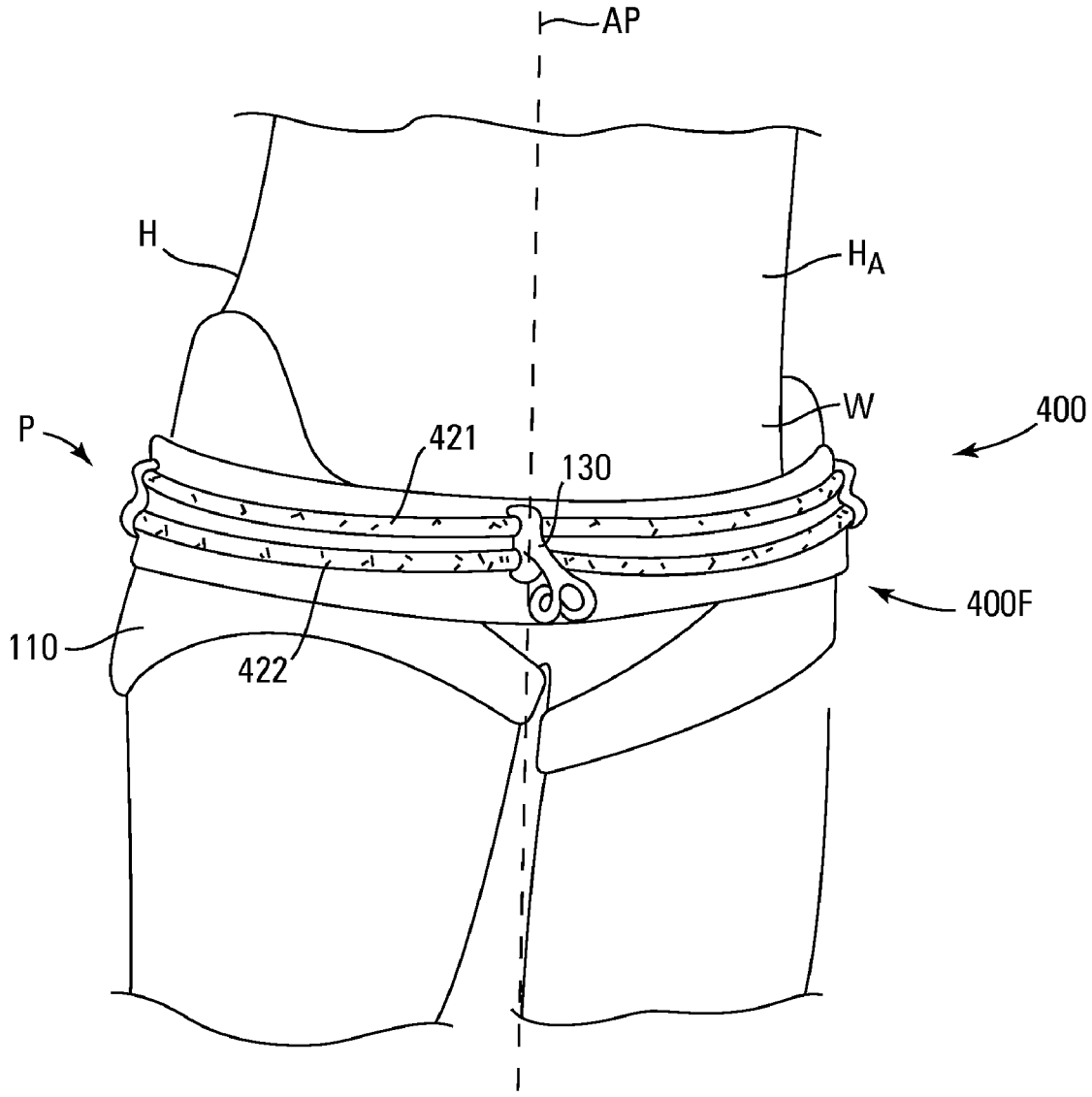
FIG. 7 is a front perspective view of a fourth embodiment of the invention worn by a kiteboarder.
Figure 8:
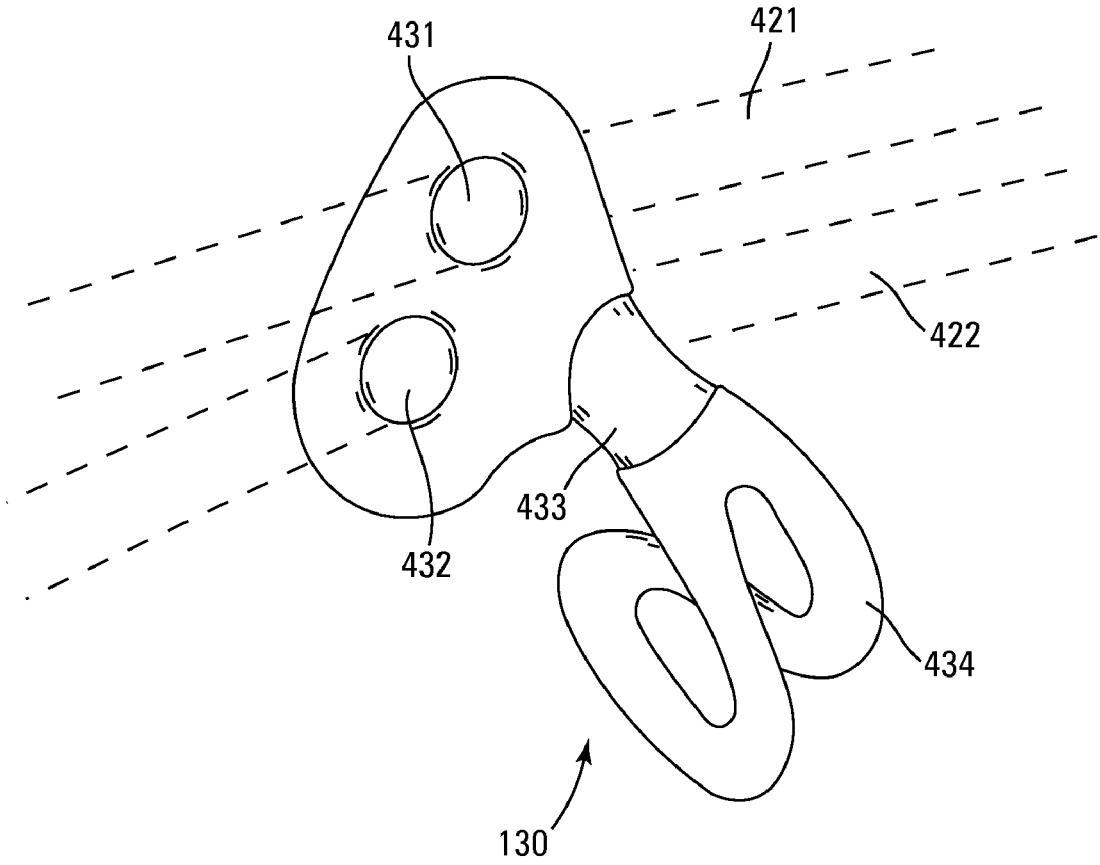
FIG. 8 is an enlarged perspective view of the hook portion of the invention shown in FIG. 7.

FIGS. 7 and 8 show a fourth embodiment of the harness 400 with a front portion $\mathbf{400}_F$ and a rear portion (not shown) separated by the coronal plane x. The fourth embodiment of the harness 400 substantially resembles the first embodiment of the harness 100, except that the single guide line 120 is replaced with a set of parallel guide lines (a superior guide line 421 and an inferior guide line 422) for engaging a pair of spaced eyelets (a superior eyelet 431 and an inferior eyelet 432) on the hook 130.

A universal joint 433 can be provided on the hook 130 between the hook portion 434 and the eyelets 431 and 432 for allowing the hook portion 434 to pivot or rotate relative to the eyelets 431 and 432 with minimal transmission of the pivoting or rotational forces to the eyelets 431 and 432. The universal joint 443 can be a ball and socket type joint or it can simply be constructed from a flexible material such as rubber or rope. The universal joint 433 can be biased (e.g., constructed from an elastic material) to return to its "home" position projecting radially outward from the girdle 110.

The fourth embodiment of the harness 400 provides several significant advantages. First, the strain exerted by the hook 130 on the guide lines 421 and 422 can be more evenly distributed.

Second, the dual points of attachment prevents the hook 130 from "sagging" downward, thereby facilitating hooking and unhooking of the chicken loop 23 onto the hooking portion 434 of the hook 130.

Fifth Embodiment

Figure 9:
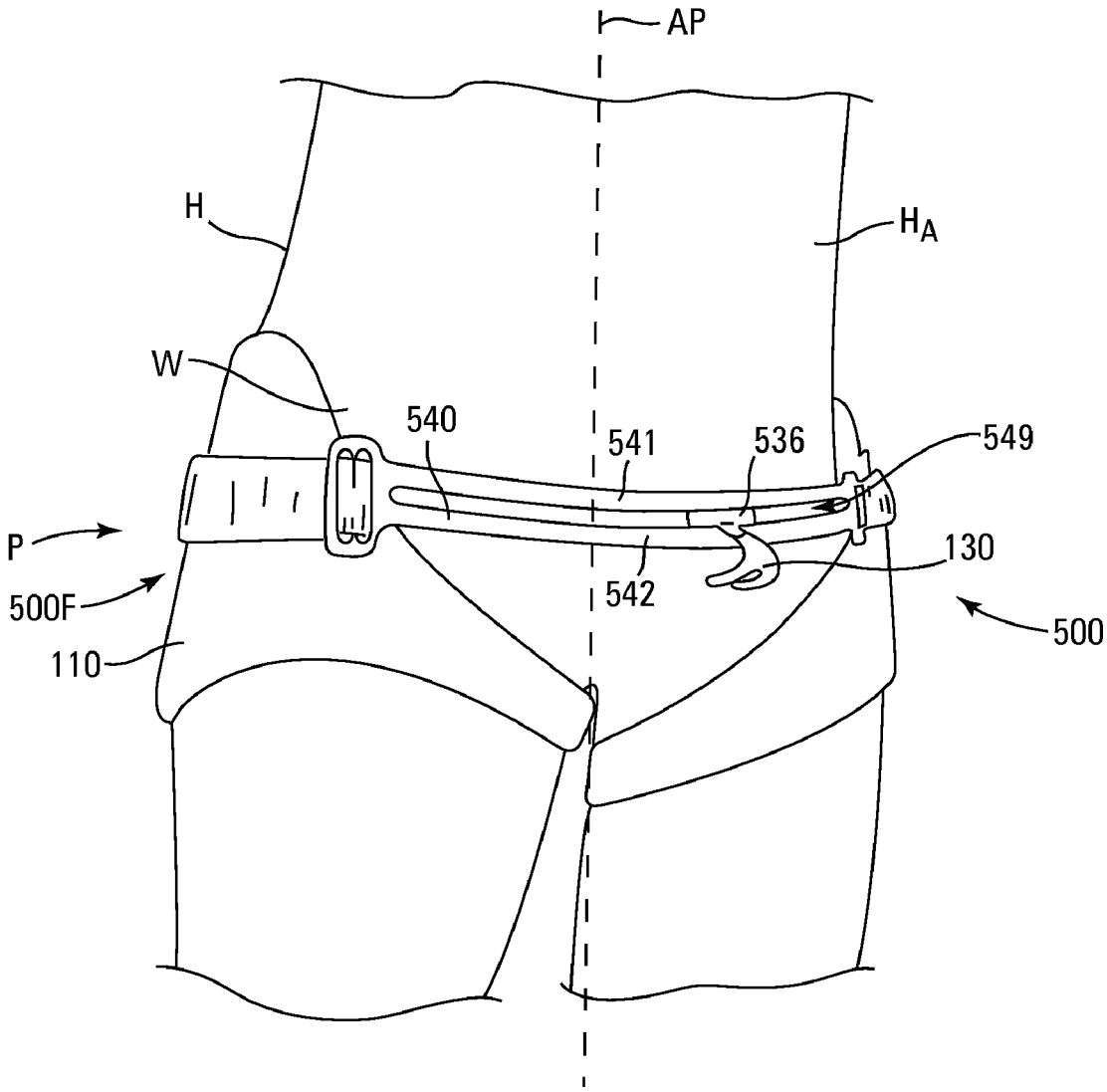
FIG. 9 is a front perspective view of a fifth embodiment of the invention worn by a kiteboarder.
Figure 10:
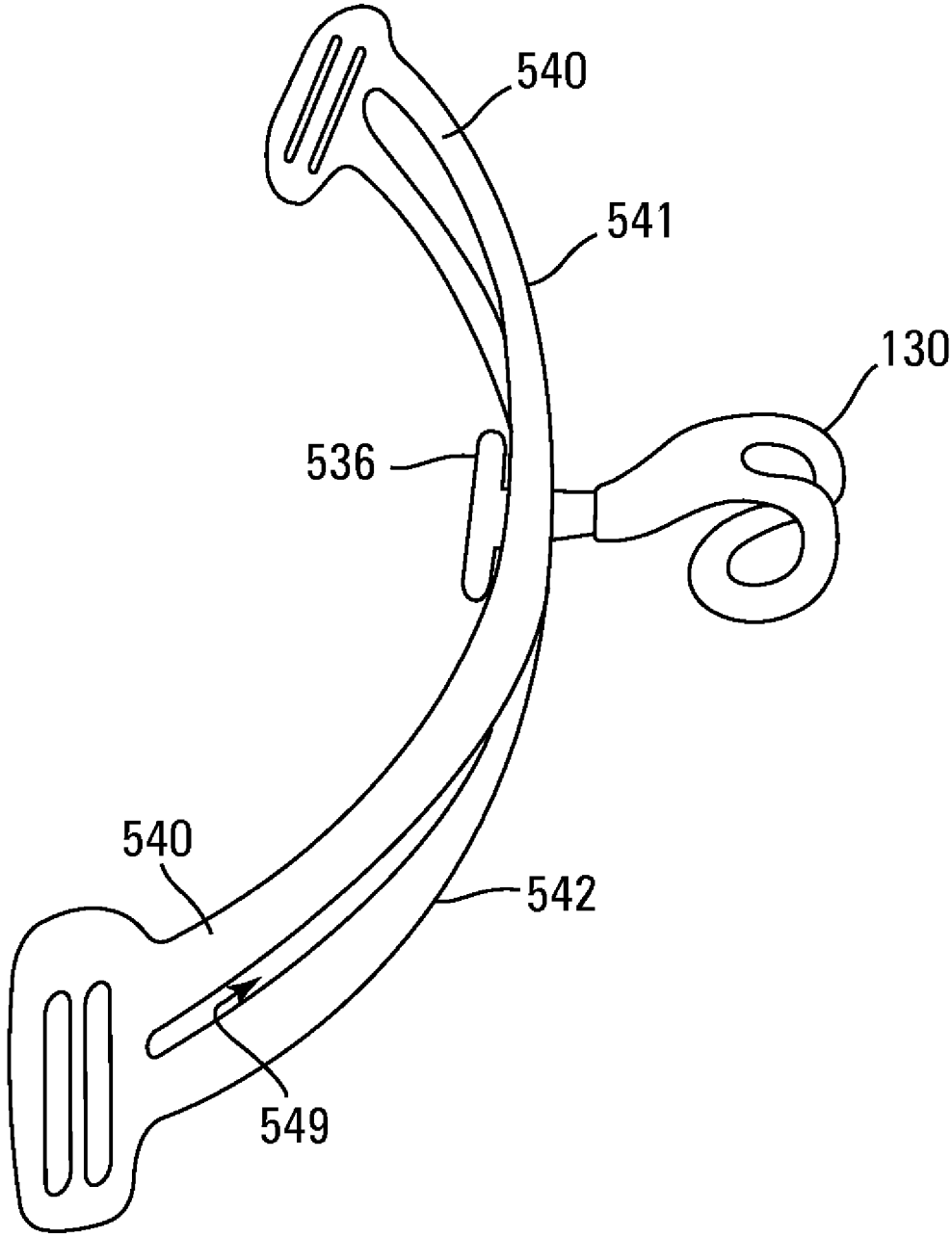
FIG. 10 is an enlarged perspective view of the spreader bar portion of the invention shown in FIG. 9.

FIGS. 9 and 10 show a fifth embodiment of the harness 500 with a front portion $\mathbf{500}_F$ and a rear portion (not shown) separated by the coronal plane x. The fifth embodiment of the harness 500 substantially resembles the third embodiment of the harness 300, except that the track 340 with a channel 349 is replaced by a track 540 with an open lateral slot 549 between a superior rail 541 and an inferior rail 542.

As with the third embodiment of the harness 300, a head 536 is provided on the proximal end of the hook 130 for sliding engagement against the backside (unnumbered) of the rails 541 and 542.

The third embodiment of the harness 300 provides several significant advantages. First, the track 540 is effective for distributing any pull force Q from the kite 10 to both sides of the pelvis P.

Second, the mechanism for slidably connecting the hook 130 to the harness 500 can be constructed to allow the hook 130 to travel laterally Lat around the wearer H with little or no friction, thereby virtually eliminating the creation of torsion forces (i.e., forces tending to twist the body of the wearer H about the anteroposterior axis AP).

Third, the track 540 can configured and arranged to mimic a conventional spreader bar so as to permit the track 540 to be retrofit onto an existing garment 110.

MODIFICATIONS

The embodiments or examples discussed above can be combined in various ways without departing from the invention. Moreover, the present invention should not be considered limited to the particular examples described above, but rather should be understood to cover all aspects of the invention as fairly set out in the claims arising from this application. For example, while suitable sizes, shapes, materials, configurations, fastener types and the like have been disclosed in the above discussion, it should be appreciated that these are provided by way of example and not of limitation as a number of other sizes, shapes, materials, configurations, fastener types, and so forth may be used without departing from the invention. Various modifications as well as numerous structures to which the present invention may be applicable will be readily apparent to those of skill in the art to which the present invention is directed upon review of the present specifications. The claims which arise from this application are intended to cover such modifications and structures.

We claim:

1. Kiteboarding gear comprising:

(a) a kiteboarding harness with a hook extending radially outward from the harness and slidably attached to the harness for lateral repositioning of the hook on the harness at least 130° about an anteroposterior axis of a human wearing the harness, (b) a kite, and (c) rigging configured and arranged for attaching the hook on the harness to the kite whereby wind force can be used to propel a user wearing the harness across a surface.

2. The kiteboarding gear of claim 1 wherein the harness is a seat harness.

3. The kiteboarding gear of claim 1 wherein the harness is a waist: harness.

4. The kiteboarding gear of claim 1 wherein the harness is a chest harness.

5. The kiteboarding gear of claim 1 wherein the hook may be repositioned at least 150° about the anteroposterior axis.

6. The kiteboarding gear of claim 1 wherein the hook may be repositioned at least 180° about the anteroposterior axis.

7. The kiteboarding gear of claim 1 wherein the kiteboarding harness has (i) a guide line extending about an anteroposterior axis of a human wearing the harness, and (ii) the hook receives and encircles the guide line so as to permit lateral sliding of the hook along the guide line.

8. The kiteboarding gear of claim 7 wherein the guide line passes through an eyelet in the hook.

9. The kiteboarding gear of claim 1 wherein the hook may be repositioned approximately 360° about the anteroposterior axis.

* * * * *